US012291867B1

(12) United States Patent
Alqarni et al.

(10) Patent No.: US 12,291,867 B1
(45) Date of Patent: May 6, 2025

(54) COMPOSITE STRUCTURAL ELEMENT, A STRUCTURE INCLUDING THE COMPOSITE STRUCTURAL ELEMENT, AND A METHOD OF FORMING THE COMPOSITE STRUCTURAL ELEMENT

(71) Applicant: KING SAUD UNIVERSITY, Riyadh (SA)

(72) Inventors: Ali Saeed Alqarni, Riyadh (SA); Abdulrahman Sulaiman Albidah, Riyadh (SA); Raed Magdi Alwafaei, Riyadh (SA)

(73) Assignee: KING SAUD UNIVERSITY, Riyadh (SA)

( * ) Notice: Subject to any disclaimer, the term of this patent is extended or adjusted under 35 U.S.C. 154(b) by 0 days.

(21) Appl. No.: 18/750,162

(22) Filed: Jun. 21, 2024

(51) Int. Cl.
*E04C 3/293* (2006.01)
*E04C 5/06* (2006.01)

(52) U.S. Cl.
CPC ..... *E04C 3/293* (2013.01); *E04C 5/0604* (2013.01)

(58) Field of Classification Search
CPC ..... E04C 3/293; E04C 3/294; E04C 5/0613; E04C 5/0604
See application file for complete search history.

(56) References Cited

U.S. PATENT DOCUMENTS 947,514 A * 1/1910 Stevens ..... E04C 3/293 52/480
1,971,051 A * 8/1934 Reiner ..... E04C 3/44 52/301
3,316,724 A * 5/1967 Tsuzuki ..... E02D 5/523 405/251
4,018,055 A * 4/1977 Le Clercq ..... E02D 5/30 52/741.15
4,105,739 A * 8/1978 Dave ..... E04C 3/29 52/659
4,905,440 A * 3/1990 Schilger ..... E04C 3/293 52/368
5,012,622 A * 5/1991 Sato ..... E04B 1/30 52/848

(Continued)

OTHER PUBLICATIONS

Qing-Jun Chen, et al., "Seismic behaviour of a through-beam connection between concrete-filled steel tubular cols. and reinforced concrete beams", DOI: https://doi.org/10.1016/j.engstruct.2014.08.036.

(Continued)

*Primary Examiner* — Christine T Cajilig
(74) *Attorney, Agent, or Firm* — Nath, Goldberg & Meyer; Joshua B. Goldberg

(57) ABSTRACT

A composite structural element includes a concrete member and a hollow member covering a part of a length of the concrete member. The concrete member has a first end, a second end, and a first elongated body extending between the first and second ends. The first elongated body has a first length between the first and second ends thereof. The hollow member has a first open end, a second open end, and a second elongated body extending between the first and second open ends. The second elongated body has a second length that is shorter than the first length. The hollow member may include a plurality of studs and a stiffener on its interior, in contact with the concrete member.

18 Claims, 4 Drawing Sheets

(56) References Cited

U.S. PATENT DOCUMENTS

| | | | | |
|---|---|---|---|---|
| 5,263,297 | A * | 11/1993 | Kim | E04C 3/34 52/301 |
| 8,474,204 | B2 * | 7/2013 | Pan | E04B 1/30 52/650.1 |
| 9,096,999 | B2 * | 8/2015 | Rahimzadeh | E04C 3/293 |
| 10,087,106 | B2 * | 10/2018 | Wu | E04C 3/34 |
| 10,544,601 | B2 * | 1/2020 | Van Hoek-Patterson | E04H 12/2292 |
| 11,142,911 | B2 | 10/2021 | Chen et al. | |
| 2007/0039283 | A1 * | 2/2007 | Kim | E01D 19/02 52/843 |
| 2010/0170183 | A1 | 7/2010 | Abulaban | |
| 2012/0011805 | A1 * | 1/2012 | Yang | B32B 15/18 428/464 |
| 2023/0037589 | A1 * | 2/2023 | Lee | E04C 3/07 |

OTHER PUBLICATIONS

Mengjiao Lv, et al., Experimental Study on Seismic Behavior of Newly Assembled Concrete Beam—Column Joints with L-Shaped Steel Bars, DOI : https://doi.org/10.3390/app14031262; 2024.

Mohammad Manzoor Nasery, et al., "Effects of support type and geometric shape of steel tube on concrete-encased concrete-filled steel tube beam under low velocity impact", DOI: https://doi.org/10.1016/j.istruc.2022.11.075.

* cited by examiner

COMPOSITE STRUCTURAL ELEMENT, A STRUCTURE INCLUDING THE COMPOSITE STRUCTURAL ELEMENT, AND A METHOD OF FORMING THE COMPOSITE STRUCTURAL ELEMENT

TECHNICAL FIELD

The present disclosure relates to civil engineering, and more particularly, to a composite structural element, a structure including the composite structural element, and a method of forming the composite structural element.

DISCUSSION OF THE RELATED ART

Concrete-filled steel tubes (CFST) are composite structural elements utilized in various civil engineering applications such as the construction of buildings, bridges, etc. CFSTs can be utilized as flexural or/and axial members (i.e., as beams and columns). CFSTs are generally created by filling a steel tube with concrete. More specifically, the steel tube runs like a sleeve, covering all the side surfaces of the concrete member along the entire length of the concrete member.

CFSTs feature good structural integrity, high strength and stiffness, good load bearing capacity, high resistance to shear force, good fire resistance, and good energy absorption capability. However, the lack of a practical and economical way of connecting two or more CFSTs to one another (e.g., beam to column) is considered a drawback of CFSTs. This is because at each joint, the concrete members of two or more CFSTs must be connected to one another, and the steel tubes covering each concrete member must also be connected to one another on the outside of the concrete members (or at least approach one another closely, thereby making the construction of the overall structure difficult).

This drawback often serves to discourage the use of CFSTs from a construction project altogether.

SUMMARY

The present disclosure relates to a composite structural element, a structure including the composite structural element, and a method of forming the composite structural element. A composite structural element as disclosed in this specification provides virtually all of the benefits of a conventional CFST while minimizing the drawbacks of conventional CFSTs.

The present disclosure achieves this result by utilizing a steel tube to cover (and therefore, to reinforce) only a portion of the length (or span) of a concrete beam member. Since the steel tube does not cover the entire span of the concrete member, the steel tube is not present at (stated otherwise, does not extend to) one or both ends of the concrete member. Therefore, there is no need to connect the steel tube to any other structure at the joint at one end or at both ends of the composite structural element.

This configuration solves the drawback associated with conventional CFSTs, where the steel tube must extend over the entire length of the concrete member and therefore, must be connected to the adjoining beam/column at both joints (or ends) thereof. The partial-length steel-tube configuration of the composite structural element of the present disclosure greatly reduces the costs associated with designing and constructing the joints where two or more concrete members connect to one another and the cost of steel tube materials (full covering of a beam vs. partial-length covering of a beam).

In addition, the steel tube of the structural element of the present disclosure can be disposed to cover the length portion (or span portion) of the concrete member that will be subjected to a significant amount of bending moment, a significant amount of shear force, and/or a significant amount of axial force. This configuration ensures that the steel tube can greatly increase the strength, stiffness, load bearing capacity (e.g., the resistance to a bending moment, shear force and axial force acting on the member), energy absorption capacity and fire resistance capability of the partially encased concrete member. The configuration of the partial-length steel-tube-sleeve over a concrete member of the present disclosure can be used to achieve a composite structural member that has virtually the same strength as that of a conventional CFST with a lower design cost (since connections for the steel tube to other structural elements at the joints need not be designed) and a lower construction cost than that of a conventional CFST (since the construction crew need not connect the ends of the steel tube to any other structural elements at the joints of the concrete beam).

A partial-length steel-tube-sleeve over a concrete beam as described in this specification is stronger than a conventional reinforced concrete member (of the same cross-sectional dimensions) not encased by a steel tube due to the reinforcement provided by the steel tube. The configuration of the composite structural element of the present disclosure can be used to reduce the cross-sectional size of the beams of a structure, as compared to a non-steel-tube-sleeved concrete member, while providing the same structural strength as that of the larger conventional concrete members.

In the present disclosure, a steel tube is used to encase only the most critical region of the structural member (e.g., beam). In beams, the flexure behavior is mostly governed by the response of the mid-span region of the beam, which in most loading scenarios develop the maximum moment. Additionally, the mid-span deflection of a beam is largely contributed to the plastic deformation of the beam, which coincides with the location of the maximum moment along the length of the beam. Minimal contribution in deformation, bending and/or sagging of a beam results from the remaining portion of the beam span (i.e., limited elastic deformations). In order to improve the flexural strength (i.e., moment capacity) and reduce the span deflection, a steel tube is used in the present disclosure to partially encase a beam over a limited span of its length (i.e., the steel tube covers at least the potential plastic hinge region). This efficient use of a steel tube will achieve most benefit in a concrete beam encased by the steel tube while eliminating most of the concerns including the challenges associated with the connectivity between the beam and other structural members.

Importantly, the implementation of the tube in a structural member including a beam as described in this specification will allow (i) reaching the targeted flexural strength of the member with less longitudinal reinforcement, thereby offering material savings and reducing the issue of congestions in heavily reinforced sections, (ii) controlling the deflection of the beam at the serviceability limit state (e.g., when the beam is heavily loaded), hence allowing for a reduction in the beam depth which is desirable for architectural aspects, and/or allowing for longer span lengths without the need for increasing the beam thickness, and (iv) enhancing the beam toughness and ductility which is desirable in earthquake prone regions.

BRIEF DESCRIPTION OF THE DRAWINGS

The above and other features of the present disclosure will become more apparent by describing in detail exemplary embodiments thereof in conjunction with the accompanying drawings, in which.

DETAILED DESCRIPTION OF THE EMBODIMENTS

Figure 1:
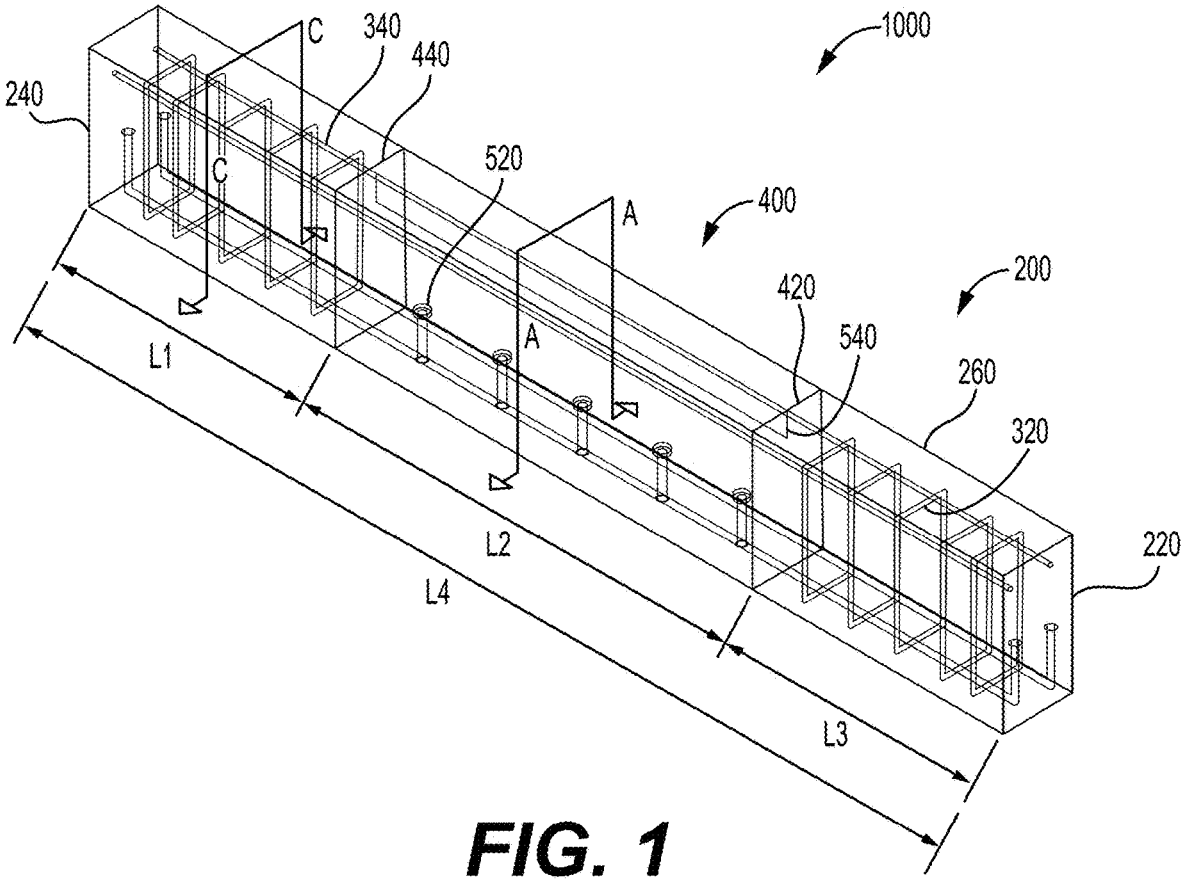
FIG. 1 is a perspective view illustrating a composite structural element according to an exemplary embodiment of the present disclosure.

Exemplary embodiments of the present disclosure will be described more fully hereinafter with reference to the accompanying drawings. The present disclosure may, however, be embodied in different forms and should not be construed as being limited to the embodiments set forth herein. Like reference numerals may refer to like elements throughout the specification. The sizes and/or proportions of the elements illustrated in the drawings may be exaggerated for clarity.

When an element is referred to as being disposed on another element, intervening elements may be disposed therebetween. In addition, elements, components, parts, etc., not described in detail with respect to a certain figure or embodiment may be assumed to be similar to or the same as corresponding elements, components, parts, etc., described in other parts of the specification.

Throughout the application, where compositions are described as having, including, or comprising specific components, or where processes are described as having, including, or comprising specific process steps, it is contemplated that compositions of the present teachings can also consist essentially of, or consist of, the recited components, and that the processes of the present teachings can also consist essentially of, or consist of, the recited process steps.

It is noted that, as used in this specification and the appended claims, the singular forms "a", "an", and "the" may include plural references unless the context clearly dictates otherwise.

In the application, where an element or component is said to be included in and/or selected from a list of recited elements or components, it should be understood that the element or component can be any one of the recited elements or components, or the element or component can be selected from a group consisting of two or more of the recited elements or components. Further, it should be understood that elements and/or features of a composition or a method described herein can be combined in a variety of ways without departing from the spirit and scope of the present teachings, whether explicit or implicit herein.

The use of the terms "include," "includes", "including," "have," "has," or "having" should be generally understood as open-ended and non-limiting unless specifically stated otherwise.

The use of the singular herein includes the plural (and vice versa) unless specifically stated otherwise. In addition, where the use of the term "about" is before a quantitative value, the present teachings also include the specific quantitative value itself, unless specifically stated otherwise. As used herein, the term "about" refers to a ±10% variation from the nominal value unless otherwise indicated or inferred.

The term "optional" or "optionally" means that the subsequently described event or circumstance may or may not occur, and that the description includes instances where said event or circumstance occurs and instances in which it does not.

Unless defined otherwise, all technical and scientific terms used herein have the same meaning as commonly understood to one of ordinary skill in the art to which the presently described subject matter pertains.

Where a range of values is provided, for example, concentration ranges, percentage ranges, or ratio ranges, it is understood that each intervening value, to the tenth of the unit of the lower limit, unless the context clearly dictates otherwise, between the upper and lower limit of that range and any other stated or intervening value in that stated range, is encompassed within the described subject matter. The upper and lower limits of these smaller ranges may independently be included in the smaller ranges, and such embodiments are also encompassed within the described subject matter, subject to any specifically excluded limit in the stated range. Where the stated range includes one or both of the limits, ranges excluding either or both of those included limits are also included in the described subject matter.

FIGS. 1-5 illustrate a composite structural element 1000 according to an exemplary embodiment of the present disclosure. Referring to FIGS. 1-5 the composite structural element includes a concrete member 200 and a hollow member 400 covering the concrete member 200 all-around along a portion of a length of the concrete member 200. The hollow member 400 may cover, for example, an exterior portion of the concrete member 200.

The concrete member 200 is a beam. In the non-limiting embodiment described with reference to FIGS. 1-5, the concrete member 200 is a beam.

Referring to FIG. 1, the concrete member 200 has a first end 220, a second end 240, and a first elongated body 260 extending between the first and second ends 220, 240. The first elongated body 260 may be referred to as the "body 260" for brevity, and the terms "the first elongated body 260" and "the body 260" are used interchangeably herein. The body 260 may be made of concrete. As illustrated in FIG. 1, the body 260 has a first length L4 between the first and second ends 220, 240. The first length L4 is the total sum of lengths L1, L2 and L3.

As illustrated in FIG. 1, the concrete member 200 may include a plurality of stirrups 320 embedded within the first elongated body 260. The stirrups 320 may be spaced apart from one another along the first length L4 of the first elongated body 260. While the length portion of the first elongated body 260 covered by the hollow member 400 is illustrated as not including any stirrups 320 embedded therein, this configuration is non-limiting. For example, stirrups 320 may also be disposed within the portion of the body 260 covered by the hollow member 400 as taught in this specification.

In addition, the concrete member 200 may include at least one elongated reinforcement member 340 embedded within the first elongated body 260 for reinforcement. As exemplarily illustrated in FIG. 1, the concrete member 200 includes a plurality of elongated reinforcement member members 340. Each one of the elongated reinforcement member(s) 340 extends in a lengthwise direction of the first elongated body 260 (e.g., between the first and second ends 220, 240). In addition, each one of the elongated reinforcement member(s) 340 may be connected to the stirrups 320 along a length of the member 340. This configuration reinforces the concrete member 200 from inside.

Each stirrup 320 may be made of a plurality of bars (e.g., four bars arranged in a rectangular shape), as exemplarily illustrated in FIG. 1. The plurality of bars may be, for example, steel rebars or reinforcement bars made of a material other than steel (e.g., a bar made of a metal other than steel). Alternatively, or in addition, the plurality of bars of each stirrup 320 may be fiber reinforced polymer (FRP) tubes (or FRP bars).

Each elongated reinforcement member 340 may be, for example, a steel rebar or a reinforcement bar made of a material other than steel (e.g., a bar made of a metal other than steel). Alternatively, or in addition, each elongated reinforcement member 340 may be an FRP tube or FRP bar.

Figure 2:
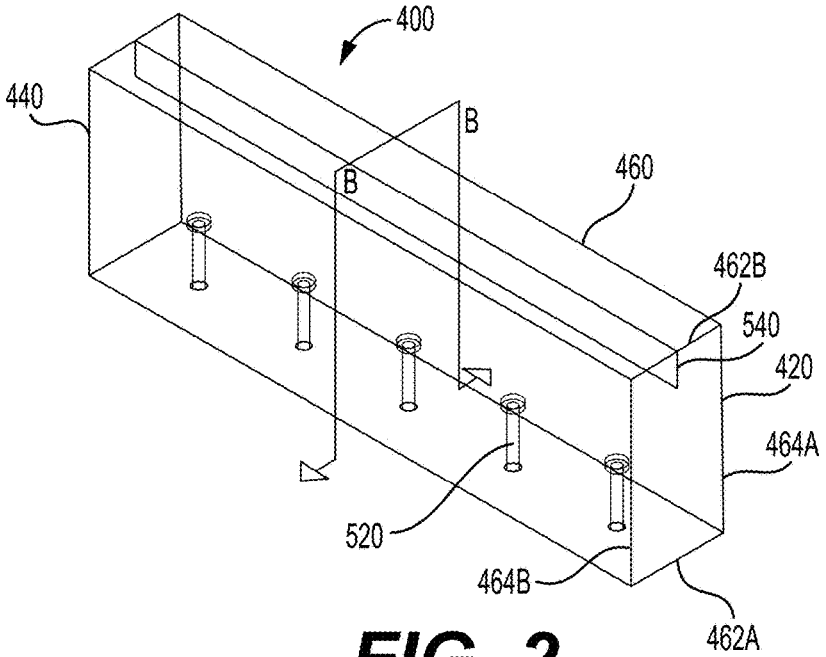
FIG. 2 is a perspective view illustrating a tube reinforcement member of the composite structural element of FIG. 1, in isolation from a concrete member of the composite structural element of FIG. 1.

Referring to FIGS. 1 and 2, the hollow member 400 has a first open end 420, a second open end 440, and a second elongated body 460 extending between the first and second open ends 420, 440. The second elongated body 460 may be referred to as the "body 460" for brevity purposes herein. The body 460 has a second length L2. As illustrated in FIG. 1, the second length L2 is shorter than the first length L4.

The hollow member 400 may be, for example, what is referred to as a hollow structural section (HSS) in the field of civil engineering (and also a "tube," as used in this specification). An HSS is typically a hollow metal tube. Alternatively, or in addition, the hollow member 400 may be manufactured by obtaining a plurality of metal panels, matching the dimensions of the faces of the concrete member 200, and connecting the metal panels to one another along their respective adjoining edges on the exterior surface of the concrete member 200 (with the resulting hollow member 400 being shorter in length than the concrete member 200).

The body 460 of the hollow member 400 may be made of a metal. The metal may be, for example, steel, aluminum, etc. The steel may be, for example, carbon steel, such as structural grade steel (non-stainless) of different strength grades. The steel may also be, for example, stainless steel (e.g., structural grade stainless steel). The body 460 of the hollow member 400 may also be made of metals other than steel and aluminum, including alloys of different metals (e.g., brass).

Referring to FIGS. 1 and 2, the hollow member 400 may include a plurality of studs 520 spaced apart from one another in a lengthwise direction of the body 460 (e.g., between the first and second open ends 420, 440) and connected to the body 460 in an interior of the body 460. The studs 520 may be made of a metal, as described in this specification for the body 460. The studs 520 may, for example, be welded to the body 460. The studs 520 may include a head, as illustrated in FIGS. 1 and 2, or may be headless.

Referring to FIGS. 1 and 2, the hollow member 400 may also include a stiffener 540. The stiffener 540 may be an elongated plate, connected to the interior of the body 460, extending in the lengthwise direction of the body 460, and separated from the studs 520. The stiffener 540 may be made of a metal as described in this specification for the body 460.

As illustrated in FIGS. 1 and 2, the stiffener 540 may extend along the entire length of the body 460 (i.e., the stiffener 540 may also have the length L2). However, the present disclosure is not limited to this configuration. For example, the stiffener 540 may also be shorter than the length of the body 460 (i.e., may be shorter than length L2). In other words, the stiffener 540 extends at least partially along the length of the hollow member 400. The stiffener 540 may, for example, be welded to the body 460. Alternatively, the hollow member 400 may also be provided with a plurality of shorter length stiffeners, disposed sequentially along the length of the member 400, instead of one long stiffener 540.

The hollow member 400 may have different cross-sectional shapes. The cross-sectional shape of the hollow member 400 may, for example, match the cross-sectional shape of the concrete member 200.

For example, the body 460 of the hollow member 400 may have a polygonal cross-section, a circular cross-section, an elliptical cross-section, an oval cross section, or a cross-section that includes a combination of straight and curved portions.

In a non-limiting embodiment, as illustrated in FIGS. 1-4, the body 460 of the hollow member 400 may have a rectangular cross-sectional shape, formed by opposing sidewalls 462A, 462B (see FIG. 2) and opposing sidewalls 464A, 464B, connected to one another as illustrated in FIGS. 1-4. As illustrated in FIG. 2, the studs 520 may be connected to the sidewall 462A and the stiffener 540 may be connected to the 462B. The sidewalls 462A, 462B, 464A and 464B may be flat.

As illustrated in FIG. 1, in the composite structural element 1000, the studs 520 are embedded in the concrete body 260 of the concrete member 200 in the interior of the hollow member 400. In addition, the stiffener 540 may extend (or protrude) in the concrete body 260 in the interior of the hollow member 400.

When the composite structural element 1000 is a beam, and the sidewalls 462A and 462B, respectively, correspond to the bottom of the beam and the top of the beam, the studs 520 reinforce the composite structural element 1000 by transferring stresses, occurring due to a positive bending moment between the concrete, to the metal sidewall 462A of the body 460 of the hollow member 400. The transfer of tensile stress from the body 260 of the concrete member 200 to the hollow member 400 significantly increases the strength of the structural element 1000 as a whole because concrete is weak in tension but metals (which is what the hollow member 400 is made of) have a strong resistance to tension. In addition, the studs 520 eliminate or significantly reduce slippage between the hollow member 400 and the concrete member 200.

In addition, when the composite structural element 1000 is a beam, and the sidewalls 462A and 462B, respectively, correspond to the bottom of the beam and the top of the beam, and the stiffener 540 increases the resistance of the hollow member 400 against buckling (since sidewall 462B is normally under compression when the composite structural element 1000 is subjected to a positive moment). This configuration, in turn, increases the strength of the structural element 1000 as a whole.

When the hollow member 400 includes the stiffener 540, the sidewalls of the body 460 of the hollow member 460 (for example, the sidewall 462B) may have a small thickness due to the reinforcement provided by the stiffener 540.

The studs 520 and the stiffener 540 may be disposed in the interior of the body 460 of the hollow member 400. Alternatively, or in addition, the stiffener 540 can be attached to an exterior side surface of any sidewall of the body 460.

The sidewalls of the body 460 may have a uniform thickness. However, in some non-limiting embodiments, the thickness of any one of the sidewalls of the body 460 can be increased in certain predetermined locations to increase the load resistance capacity of the composite structural element 1000 as a whole while saving materials used in forming the concrete member 200 and the hollow member 400.

Specifically, the thickness of any components of the hollow member 400 (e.g., the top flange (e.g., the sidewall 462B), bottom flange (e.g., the sidewall 462A), or web (e.g., the sidewalls 464A, 464B)) can be locally increased in accordance with the distribution of stress in the section of the body 460 to optimize the section efficiency. For example, sections of the body 460 that are analyzed and determined to be susceptible to buckling under load can be optimized by thickening the top flange (e.g., the sidewall 462B) at a location of the top flange that is susceptible to bucking. In addition, sections of the body 460 that are analyzed and determined to be susceptible to failure in tension can be optimized by thickening the bottom flange only (e.g., the sidewall 462A) at a location of the bottom flange that is susceptible to failure in tension.

The thickening process may include, for example, attaching a metal plate to a predetermined area the sidewall of the body 460 that is susceptible for failure under load by, for example, welding or bolting the metal plate to the sidewall. The metal plate can be attached, for example, to any sidewall in the interior of the body 460 or on the exterior of the body 460.

The local thickening of any sidewall of the hollow member 400 can increase the resistance of the structural element 1000 as a whole per unit weight of material used to form the structural element 1000.

As illustrated in FIG. 1, the hollow member 400 does not extend over, and therefore does not cover, the entire length L4 of the concrete member 200. For example, the hollow member 400 does not cover the length portions L1 and L3 of the concrete member 200.

The hollow member 400 may cover a length that is shorter than the length L4 of the concrete member 200 (depending on the member flexural stresses). In a non-limiting example, as illustrated in FIG. 1, the hollow member 400 covers about 50% of the length L4. In another non-limiting example, the length of the hollow member 400 ranges from about 30% to about 70% of the length of the concrete member 200. In addition, the hollow member 400 may be disposed such that its center (or mid-length), as measured in the length direction of the hollow member 400, coincides with the center of the concrete member 200, as measured along the length direction of the concrete member 200.

This configuration significantly reinforces the concrete member 200 where reinforcement is needed since the amount of stress experienced by the concrete member 200 due to load is expected to be high within the length of the concrete member 200 covered by the hollow member 400 (e.g., between approximately the central 50% portion of the length of the concrete member 200). In addition, the reinforcement of only a part of the length L4 of the concrete member 200 reduces the amount of steel used (compared to conventional CFSTs, which extend over the entire length of the concrete beam), while featuring a high strength, small cross-sectional dimensions, a high resistance to fire, a low design cost, and a low construction cost (since the ends 420 and 440 of the body 460 of the hollow member 400 need not be connected to any other structure at the joints where the first and second ends 220 and 420 of the body 260 of the concrete member 200 are connected to other structural components).

While the hollow member 400 is described as being centered about the concrete member 200, the present disclosure is not limited to this configuration. For example, the center (or mid-length) of the hollow member 400 can also be offset (or spaced apart from) the center (or mid-length) of the concrete beam 200 by a certain distance, depending on the critical moment locations. In one example, the center of the hollow member 400 can be offset by about 0% to about 20% (of the length of the concrete member 200) relative to the center (or mid-length) of the concrete member 200.

While the hollow member 400 is described as having studs 520 and the stiffener 540 attached thereto, the present disclosure is not limited to this configuration. For example, the studs 520 and/or stiffener 540 may be omitted from the hollow member 400. When the structural element 1000 is a beam, the stiffener 540 may be omitted by designing the top sidewall 462B to be thick enough to avoid bucking under compression for the loads that the structural element 1000 is designed to carry.

Figures 3, 4, 5:
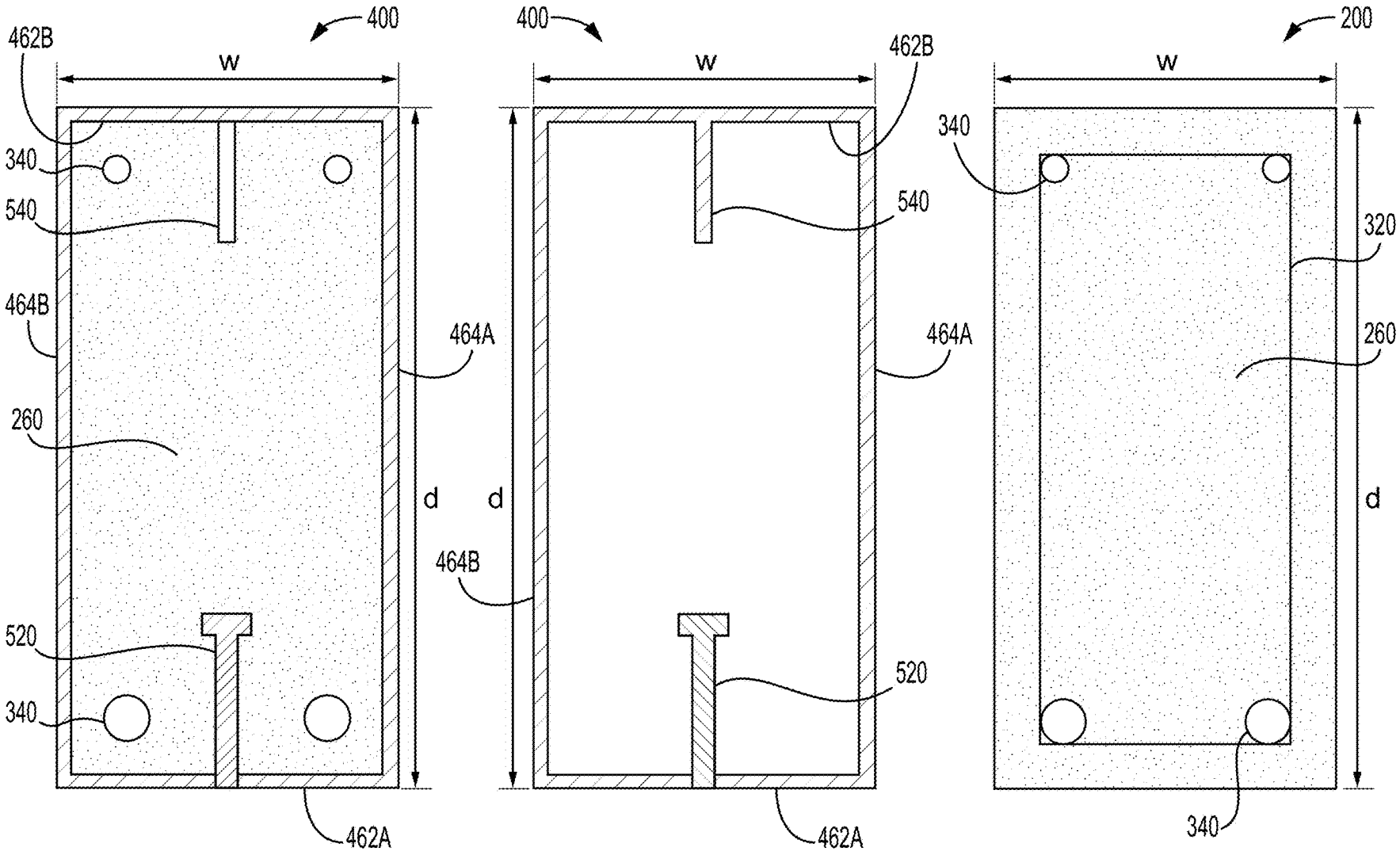
FIG. 3 is a cross-sectional view taken along line A-A of FIG. 1.
FIG. 4 is a cross-sectional view taken along line B-B of FIG. 2.
FIG. 5 is a cross-sectional view taken along line C-C of FIG. 1.

The exterior of the hollow member 400 may be flush with the exterior of the concrete member 200. Therefore, the cross-sectional dimensions of the concrete member 200 in the length regions L1 and L3 (i.e., outside of the hollow member 400), as illustrated in FIG. 5, may be the same as the cross-sectional dimensions of the hollow member 400, as illustrated in FIG. 4. The body 260 of the concrete member 200 may have its cross-section slightly reduced inside of the hollow member 400 (i.e., reduced by the wall thickness of the hollow member 400).

The structural element 1000 can be a constituent part of a structure (e.g., the structure of a building, the structure of a bridge, etc.) that includes a plurality of other structural components, whether the other structural components are conventional reinforced concrete beams or columns (i.e., concrete beams or columns that may include rebar and stirrups but no reinforcing metal tube on the outside), conventional CFSTs, or a combination thereof.

When the structure includes two structural elements 1000 directly connected to one another, the concrete member of a first structural element 1000 is directly connected to the concrete member of a second structural element 1000, while the hollow member of the first structural element 1000 might not be directly connected to the hollow member of the second structural element 2000.

A method of forming the composite structural element according to the present disclosure includes creating a formwork from a suitable material (e.g., wooden boards). The composite structural element described with reference to this method is a beam.

The formwork forms an interior space for pouring concrete in liquid form therein. The poured concrete will cure to form a concrete member as defined in this specification.

Therefore, the interior space of the formwork defines a shape and size of a concrete member that will be formed therein.

For example, the interior space of the formwork has a first length equal to the length of the concrete element, as described in this specification (e.g., length L4 when forming the concrete member 200), and a cross-sectional shape matching the cross-sectional shape of the concrete element that will be formed therein. For example, when forming the concrete member 200, the formwork may have three sidewalls having a shape and size corresponding to the sidewalls 464A, 464B and 462A (with an open top for pouring the concrete from above).

The method includes disposing a hollow member (e.g., the hollow member 400) in the interior space of the formwork. The hollow member may have a configuration as described in this specification. For example, the hollow member may be shorter than the length of the interior space of the formwork. In addition, the hollow member may include a plurality of studs and a stiffener as described in this specification.

As an example, the hollow member may have a length shorter than the length of the interior space of the formwork (e.g., from about 30% to about 70% of the length of the concrete member that will be formed by the formwork, and in one example, about 50% of the length of the concrete member that will be formed by the formwork), and may be centered about the interior space of the formwork such that the hollow member will be centered about the structural element that will be produced when the poured concrete cures. The hollow member may also include a plurality of studs and a stiffener as described in this specification.

The method may also include disposing a plurality of stirrups and at least elongated reinforcement member in the interior space of the formwork. The stirrups and the at least one elongated member may have a configuration as described in this specification, and may be spaced apart from one another in the interior space of the formwork in order to become embedded in the concrete member. The stirrups may be spaced from one another and connected to the at least one elongated concrete member as described in this specification for the stirrups 320 and the elongated member 340.

The stirrups and the at least one elongated reinforcement member may be disposed in the interior space of the formwork prior to pouring of the concrete in fluid form therein. In addition, the at least one reinforcement member may extend along at least a portion of the first length of the interior space of the formwork not overlapping the hollow member (e.g., in the areas having length L1 and/or L3 as illustrated in FIG. 1), and through the interior of the hollow member. The stirrups may be disposed in the length portions of the interior space of the formwork that are outside of the hollow member and/or inside of the hollow member prior to pouring the concrete in the interior space of the formwork.

The method then includes pouring concrete in fluid form in the interior space of the formwork to at least partially fill an interior of the hollow member and the interior space of the formwork with the concrete in fluid form. In an example, the concrete may be poured in the interior space of the formwork until it fills the hollow member completely (i.e., to the top).

Examples 1 and 2 below represent tests performed on similar concrete beams, indicating the difference in performance of a structural element 3000, having a configuration as described in this specification with reference to the structural element 1000 (Example 2, illustrated in FIGS. 8 and 9), and a control beam 2000, having a concrete member identical to the concrete member of the structural element 3000 but lacking the hollow member of the structural element 3000 (Example 1, illustrated in FIGS. 6 and 7).

EXAMPLE 1

Figure 6:
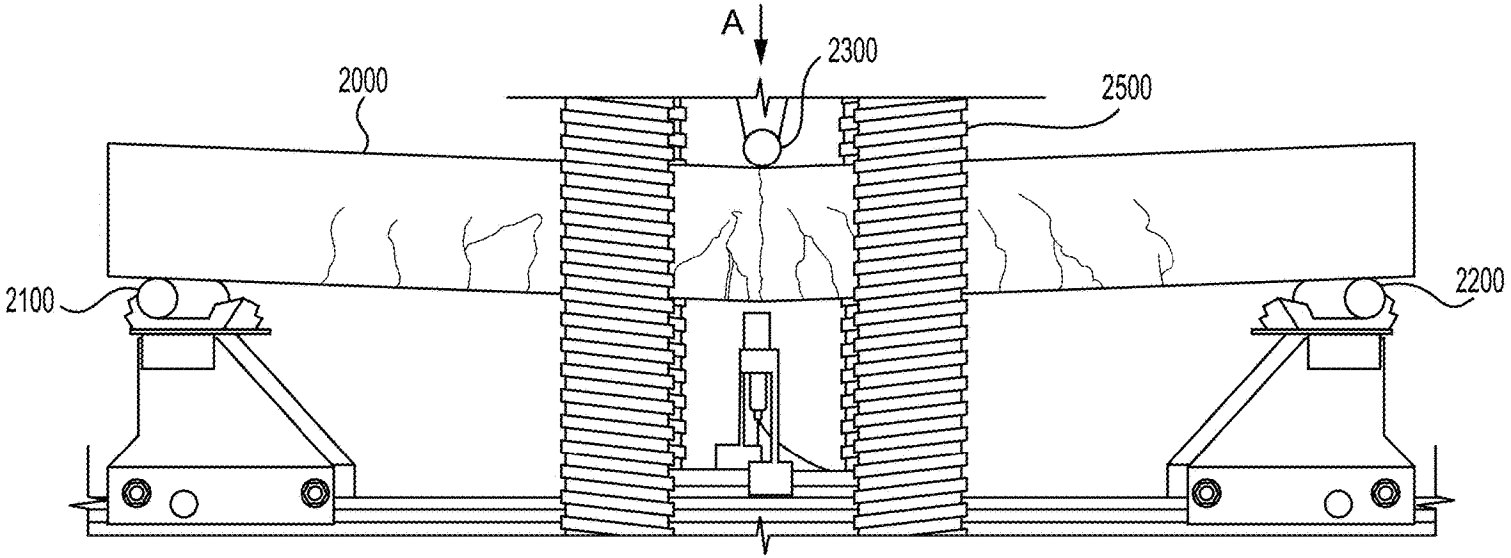
FIG. 6 is a diagram illustrating a reinforced concrete beam without a steel tube sleeve at peak load during a bending test.
Figure 7:
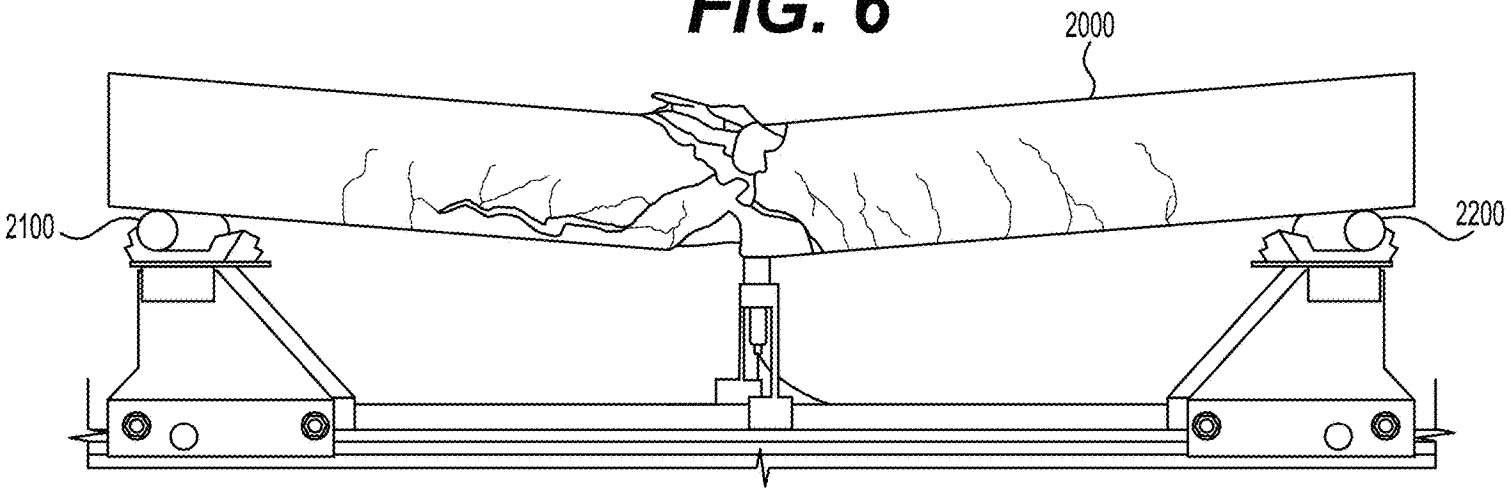
FIG. 7 is a diagram illustrating the beam of FIG. 6 after having failed as a result of the bending test.

FIGS. 6-7 illustrate a control reinforced concrete beam 2000 with a cross-section of 200 mm wide (see FIG. 5, illustrating the orientation in which the width "w" is measured) by 400 mm deep (see FIG. 5, illustrating the orientation in which the depth "d" is measured).

The length of the beam 2000 in between the rollers 2100 and 2200 is 1.8 m. The beam 2000 includes reinforcement bars embedded therein. Arm 2300 of the hydraulic press 2500 initially made contact with the beam 2000 at mid-length thereof, and was then selectively lowered in the direction A, as illustrated in FIG. 6, to load the beam 2000 at its mid-span. FIG. 6 illustrates the beam 2000 when reaching the peak load. FIG. 7 illustrates the beam 2000 after having failed due to the load exerted on it by the arm 2300.

The beam 2000 failed at a load of 171 kN, and deflected downwardly by 33.77 mm at failure.

Figure 8:
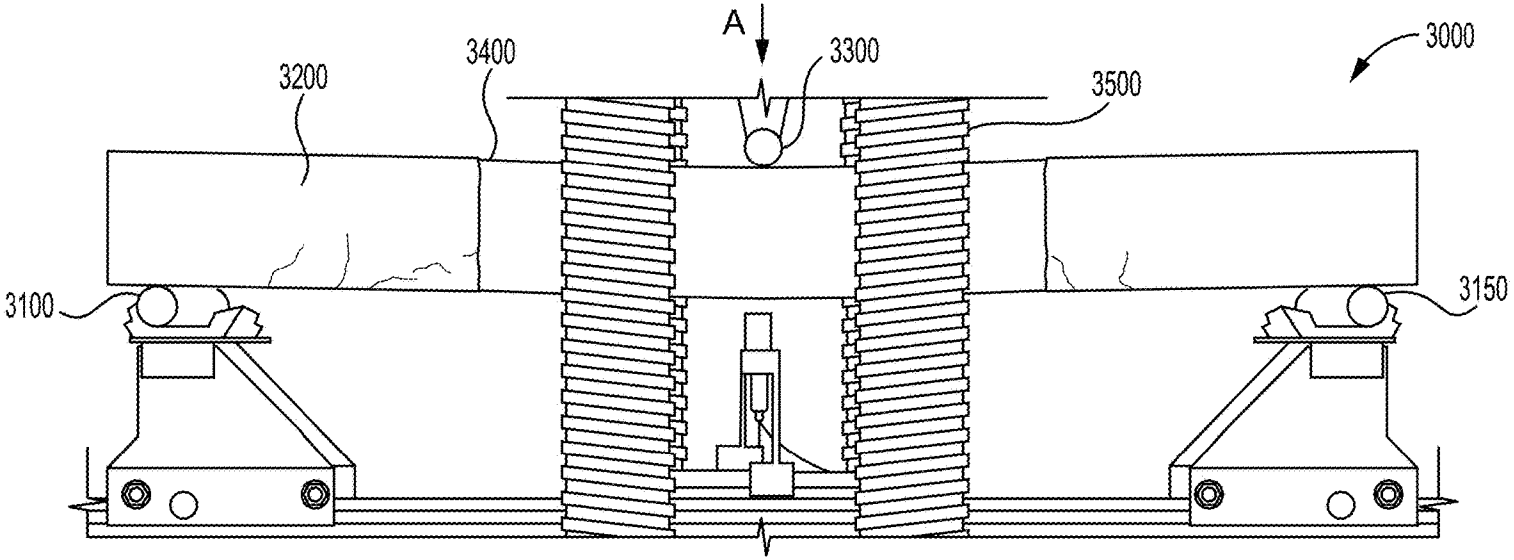
FIG. 8 is a diagram illustrating a composite structural element of the present disclosure, including a reinforced concrete beam with a steel tube sleeve covering a part of the length of the concrete beam, at peak load during a bending test.
Figure 9:
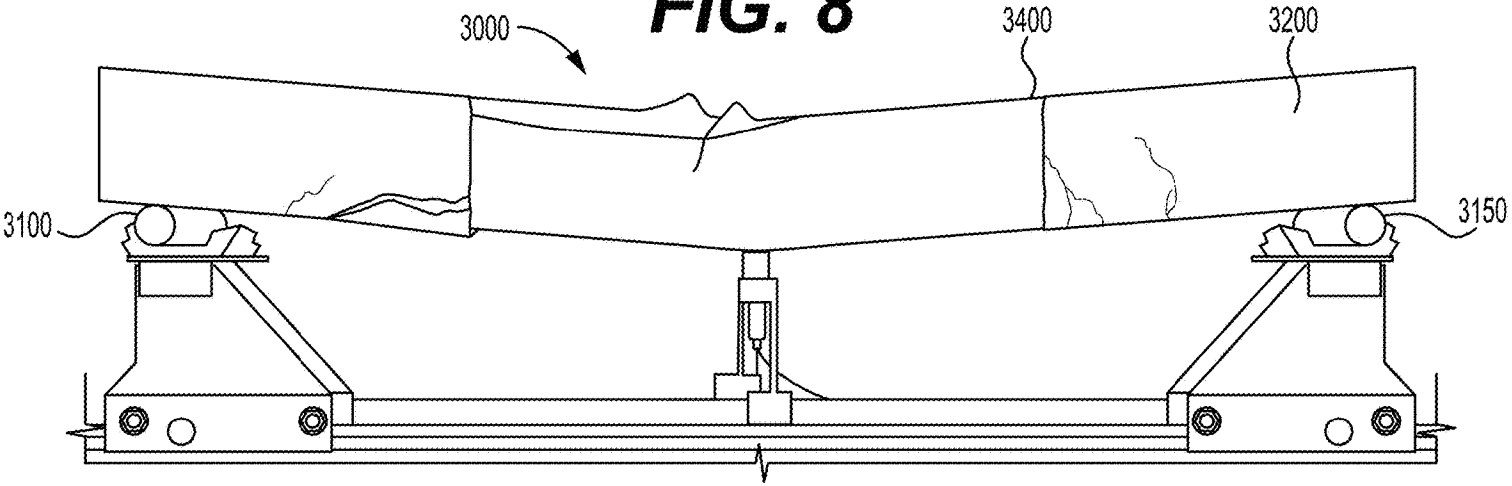
FIG. 9 is a diagram illustrating the composite structural element of FIG. 8 after having failed as a result of the bending test.

Referring to FIGS. 8 and 9, the structural element 3000 includes a concrete beam 3200 (or concrete "member" 3200, as referred to in this specification with reference to FIGS. 1-5) and a hollow member 3400 covering the concrete beam 3200 along 50% of the 1.8 m length of the beam 3200.

The beam 3200 is identical to the beam 2000 in all aspects. That is, the beam 3200 has a cross-section with a 200 mm width "w" and a 400 mm depth "d" (see FIG. 5 for reference), it is 1.8 m long between the rollers 3100 and 3150, is made of the same concrete as the control beam 200 and has the same reinforcement bars embedded therein as the control beam 2000.

The hollow member 3400 has a configuration as described in this specification for the hollow member 400. In Example 2, the hollow member 3400 is 0.9 m long (i.e., 50% of the length of the beam 3200) and is centered about mid-length of the beam 3200. The hollow member 3400 of Example 2 has a cross-section with a width "w" of 200 mm (see FIGS. 3 and 4 for reference), a depth "d" of 400 mm, and a wall (or "sidewall") thickness of 1.4 mm.

In Example, 2, the hollow member 3400 (or the "sidewalls" forming the body of the hollow member 3400) is made of steel. In this example, the hollow member 3400 is made of a steel having a yield strength of 288 MPa. The hollow member 3400 also included a plurality of studs and stiffeners attached to its bottom and top sidewalls on the interior of the hollow member 3400. In Example 2, the hollow member 3400 includes two rows of studs spaced longitudinally at 100 mm. Each stud has a height of 120 mm and 20 mm diameter.

In Example 2, each the stiffener is a metal plate having a 50 mm depth and 1.4 mm thickness along the length of the hollow member 3400.

Arm 3300 of the hydraulic press 3500 initially made contact with the structural element 3000 at mid-length thereof (at mid-length of the hollow member 3400), and was then selectively lowered in the direction A, as illustrated in FIG. 8, to load the structural element 3000 at its mid-span. FIG. 8 illustrates the structural element 3000 when reaching the peak load. FIG. 9 illustrates the structural element 3000 after having failed due to the load exerted on it by the arm 3300.

The structural element 3000 failed at the load of 229 kN, and deflected downwardly by 8.55 mm at failure.

These results indicate that the structural element 3000 exhibited a 33.92% increase in flexural strength as compared to the control beam 2000 (i.e., 229 kn versus 171 kN). The deflection of the structural element 3000 at its failure load was significantly reduced (by about 74.68%) as compared to the deflection of the control beam 2000 at its failure load (i.e., 8.55 mm versus 33.77 mm).

The flexural stiffness value of the control beam 2000 was 16.44 kN/mm while the flexural stiffness value for the structural element 3000 was 28.54 kN/mm. This indicates that structural element 3000 exhibited a 73.6% increase in flexural stiffness over the control beam 2000 (i.e., 16.44 kN/mm versus 28.54 kN/mm). The ductility index of the control beam 2000 was 2.99 while the ductility index for structural element 3000 was 9.3. This indicates that structural element 3000 exhibited an improvement in the ductility index by 211.04%.

Therefore, Examples 1 and 2 demonstrate a significant increase in performance between the structural element 3000 and the control beam 2000 even though the wall thickness of the hollow member 3400 was very small (i.e., 1.4 mm). These results indicate that a significant increase in performance in a concrete beam can be achieved when constructing the beam as taught by this specification.

While the present disclosure has been particularly shown and described with reference to exemplary embodiments thereof, it will be apparent to those of ordinary skill in the art that various changes in form and detail may be made therein without departing from the spirit and scope of the present disclosure as defined by the following claims.

What is claimed is:

1. A composite structural element, comprising:

a concrete member having a first end, a second end, and a first elongated body extending between the first and second ends thereof, the first elongated body having a first length between the first and second ends thereof; and a hollow member having a first open end, a second open end, and a second elongated body extending between the first and second open ends thereof, the second elongated body having a second length that is shorter than the first length, the second elongated body covering the first elongated body along the second length thereof, wherein the second length of the second elongated body of the hollow member ranges from about 30% to about 70% of the first length of the first elongated body of the concrete member, wherein the second elongated body includes a plurality of sidewalls connected to one another and extending between the first and second ends of the second elongated body, the plurality of sidewalls defining an exterior of the second elongated body member and an interior of the second elongated body, and wherein the composite structure further includes at least one stud connected to a first sidewall from among the plurality of sidewalls in the interior of the second elongated body, the at least one stud being embedded in the first elongated body of the concrete member, thereby connecting the hollow member and the concrete member to one another.

2. The composite structural element of claim 1, further comprising a stiffener connected to a second sidewall, from among the plurality of sidewalls, in the interior of the second elongated body, the stiffener extending along at least a portion of the second length in the interior of the second elongated body.

3. The composite structural element of claim 2, wherein the first and second sidewalls are disposed on opposite sides of the second elongated body of the hollow member.

4. The composite structural element of claim 3, wherein the first and second sidewalls are flat.

5. The composite structural element of claim 1, wherein the second elongated body has a sidewall with a curved cross-section extending between the first and second ends of the second elongated body.

6. The composite structural element of claim 5, further comprising at least one selected from the group consisting of a stud and a stiffener connected to the sidewall with the curved cross-section in the interior of the second elongated body.

7. The composite structural element of claim 1, wherein the second elongated body of the hollow member is made of a metal.

8. A structure formed of a plurality of structural elements connected to one another, the plurality of structural elements comprising a first composite structural element, wherein the first composite structural element includes:

a concrete member having a first end, a second end, and a first elongated body extending between the first and second ends thereof, the first elongated body having a first length between the first and second ends thereof; and a hollow member having a first open end, a second open end, and a second elongated body extending between the first and second open ends thereof, the second elongated body having a second length that is shorter than the first length, the second elongated body covering the first elongated body along the second length thereof, wherein the second length of the second elongated body of the hollow member covers about 50% of the first length of the first elongated body of the concrete member, wherein the second elongated body is made of a metal.

9. The structure of claim 8, wherein the second elongated body includes a plurality of sidewalls connected to one another and extending between the first and second ends of the second elongated body, the plurality of sidewalls defining an exterior of the second elongated body member and an interior of the second elongated body, and wherein the first composite structure further comprises at least one stud connected to a first sidewall, from among the plurality of sidewalls, in the interior of the second elongated body, the at least one stud being embedded in the first elongated body of the concrete member, thereby connecting the hollow member and the concrete member to one another.

10. The structure of claim 9, wherein the first composite structure further comprises a stiffener connected to a second sidewall, from among the plurality of sidewalls, in the interior of the second elongated body, the stiffener extending along at least a portion of the second length in the interior of the second elongated body.

11. The structure of claim 8, wherein the plurality of structural elements further includes a second composite structure, wherein the second composite structure includes:

a second concrete member, the second concrete member having a first end, a second end, and a third elongated body extending between the first and second ends thereof, the third elongated body having a third length between the first and second ends thereof; and a second hollow member having a first open end, a second open end, and a fourth elongated body extending between the first and second open ends thereof, the fourth elongated body having a fourth length that is shorter than the third length, the fourth elongated body covering the third elongated body along the fourth length thereof.

12. The structure of claim 11, wherein the concrete member and the second concrete member are directly connected to one another, and wherein the hollow member and the second hollow member are not directly connected to one another.

13. The structure of claim 8, wherein the first composite structure further comprises:

a plurality of stirrups embedded within the first elongated body of the concrete member and spaced apart from one another along the first length of the first elongated body of the concrete member; and at least one reinforcement member embedded within the first elongated body of the concrete member and connecting the plurality of stirrups to one another.

14. A method of forming a composite structural element, the method comprising:

creating a formwork, the formwork forming an interior space configured to receive concrete in fluid form therein, the interior space having a first length and a cross-section defining a cross-section of a concrete beam to be formed therein;

disposing a hollow member in the interior space of the formwork, the hollow member having a first open end, a second open end, and an elongated body extending between the first and second open ends thereof, the elongated body of the hollow member having a second length between the first and second open ends thereof, the second length being shorter than the first length; and pouring concrete in fluid form in the interior space of the formwork to at least partially fill an interior of the hollow member and the interior space of the formwork with the concrete in fluid form, wherein the second length of the elongated body of the hollow member ranges from about 30% to about 70% of the first length of the interior space of the formwork.

15. The method of claim 14, further comprising disposing at least one elongated reinforcement member in the interior space of the formwork prior to the pouring of the concrete in fluid form, the at least one reinforcement member extending: a) along at least a portion of the first length of the formwork not overlapping the hollow member, and b) through an interior of the hollow member.

16. The method of claim 15, wherein the elongated body of the hollow member is made of a metal, and the at least one elongated reinforcement member is a metal reinforcement bar or a fiber reinforced polymer (FRP) bar.

17. The composite structural element of claim 1, wherein the second elongated body of the hollow member is offset by about 0% to about 20% of the length of the first elongated body of the concrete member relative to a center of the first elongated body of the concrete member.

18. The structure of claim 8, wherein the second elongated body of the hollow member is offset by about 0% to about 20% of the length of the first elongated body of the concrete member relative to a center of the first elongated body of the concrete member.

* * * * *